US012808076B2

(12) United States Patent
Liu et al.

(10) Patent No.: US 12,808,076 B2
(45) Date of Patent: Nov. 24, 2026

(54) LEVELING AGENT, COMPOSITION, AND APPLICATION THEREOF

(71) Applicants: HUAWEI TECHNOLOGIES CO., LTD., Shenzhen (CN); Fudan University, Shanghai (CN)

(72) Inventors: Xinyu Liu, Shenzhen (CN); Fei Xiao, Shanghai (CN); Yuanrong Cheng, Shanghai (CN); Guanbin Lu, Shanghai (CN); Shuo Han, Shanghai (CN); Junye Chen, Shanghai (CN)

(73) Assignees: Huawei Technologies Co., Ltd., Shenzhen (CN); Fudan University, Shanghai (CN)

( * ) Notice: Subject to any disclaimer, the term of this patent is extended or adjusted under 35 U.S.C. 154(b) by 0 days.

(21) Appl. No.: 19/066,147

(22) Filed: Feb. 27, 2025

(65) Prior Publication Data

US 2025/0215598 A1 Jul. 3, 2025

Related U.S. Application Data

(63) Continuation of application No. PCT/CN2023/115935, filed on Aug. 30, 2023.

(30) Foreign Application Priority Data

Aug. 31, 2022 (CN) ..... 202211056293.6

(51) Int. Cl.
*C25D 3/02* (2006.01)
*C25D 3/18* (2006.01)
(Continued)

(52) U.S. Cl.
CPC ..... *C25D 3/38* (2013.01)

(58) Field of Classification Search
CPC ..... C25D 3/02; C25D 3/18; C25D 3/32; C25D 3/38; C25D 3/46; C25D 3/54
(Continued)

(56) References Cited

U.S. PATENT DOCUMENTS

2006/0002889 A1* 1/2006 Fitzpatrick ..... C08G 63/6926 525/428
2010/0247880 A1 9/2010 Kano et al.
2016/0237579 A1* 8/2016 Duan ..... C09D 179/04

FOREIGN PATENT DOCUMENTS

CN 1940146 A 4/2007
CN 107236976 A 10/2017
(Continued)

*Primary Examiner* — Edna Wong
(74) *Attorney, Agent, or Firm* — Leydig, Voit & Mayer, Ltd.

(57) ABSTRACT

An embodiment of the present disclosure provides a leveling agent, which is a polypyridine compound, where the polypyridine compound includes a structural unit shown in Formula (I) or a protonated product of the structural unit shown in Formula (I):

Formula (I)

In Formula (I), $R_1$ and $R_2$ are independently any one of the following: substituted or unsubstituted alkylene, substituted or unsubstituted arylene, substituted or unsubstituted arylene alkyl, substituted or unsubstituted alkylene aryl, alkylene containing an ether oxygen atom, ester, and/or imide,
(Continued)

arylene containing an ether oxygen atom, ester, and/or imide, arylene alkyl containing an ether oxygen atom, ester, and/or imide, and alkylene aryl containing an ether oxygen atom, ester, and/or imide; and $R_3$ is any one of groups such as a single bond, substituted or unsubstituted alkylene, substituted or unsubstituted arylene, substituted or unsubstituted arylene alkyl, and substituted or unsubstituted alkylene aryl.

13 Claims, 5 Drawing Sheets

(51) Int. Cl.
*C25D 3/32* (2006.01)
*C25D 3/38* (2006.01)
*C25D 3/46* (2006.01)
*C25D 3/54* (2006.01)

(58) Field of Classification Search
USPC ..... 205/261, 263, 279, 297, 302
See application file for complete search history.

(56) References Cited

FOREIGN PATENT DOCUMENTS

| | | | | |
|---|---|---|---|---|
| JP | 2007517140 | A | 6/2007 | |
| JP | 2012510179 | A | 4/2012 | |
| JP | 2013091850 | A | 5/2013 | |
| WO | WO-2011149965 | A2 * | 12/2011 | ..... H10P 14/47 |

* cited by examiner

LEVELING AGENT, COMPOSITION, AND APPLICATION THEREOF

CROSS-REFERENCE TO RELATED APPLICATIONS

This application is a continuation of International Application No. PCT/CN2023/115935, filed on Aug. 30, 2023, which claims priority to Chinese Patent Application No. 202211056293.6, filed on Aug. 31, 2022. The disclosures of the aforementioned applications are hereby incorporated by reference in their entireties.

STATEMENT OF JOINT RESEARCH AGREEMENT

The subject matter of the present application was made by or on the behalf of Fudan University, of Yangpu District, Shanghai, P.R. China and Huawei Technologies Co., Ltd., of Shenzhen, Guangdong Province, P.R. China, under a joint research agreement titled "Fudan University-Huawei Watt Joint Innovation Center". The joint research agreement was in effect on or before the present application was made, and that the present application was made as a result of activities undertaken within the scope of the joint research agreement.

TECHNICAL FIELD

Embodiments of the present disclosure relate to the field of metal electroplating technologies, and in particular, to a leveling agent, a composition, and an application thereof.

BACKGROUND

In a manufacturing process of the electronic industry, metallic copper is widely used as an interconnection material in fields such as integrated circuits, electronic packaging, and printed circuit boards due to features such as good conductivity and good ductility. Filling electroplating copper in holes or grooves such as grooves, plated through holes, or blind via holes of different sizes is completed through an electroplating process, so that electrical interconnection between copper lines and inter-layer structures can be implemented.

However, in a process of filling electroplating copper in the hole or groove, uneven distribution of currents inside and outside the hole, and a discharge effect at a tip of the top of the hole result in different copper deposition rates inside and outside the hole. Consequently, an electroplated copper layer is likely to seal the hole in advance, leading to internal defects including a void (as shown in FIG. 1A) and a seam (as shown in FIG. 1B). This affects reliability of an interconnection structure. To eliminate the foregoing defects, an appropriate additive is generally added to an electroplating solution, to change a polarization potential of an electrode surface. This controls copper deposition rates in different regions inside and outside the hole, achieving an effect of "accelerating deposition at the bottom of the hole and inhibiting deposition at the top of the hole" during filling of the electroplating copper in the hole or groove, and finally implementing defect-free super-filling (as shown in FIG. 1C). However, after super-filling is implemented in the hole or groove, copper continues to deposit on the top of a pattern, resulting in bump defects on the top that are shown in FIG. 1A, FIG. 1B, and FIG. 1C. Consequently, during filling of holes or grooves on an entire substrate, a thickness difference between a copper layer in a high-density interconnection pattern region and a copper layer in a low-density interconnection pattern region is increased, and therefore a non-flat copper layer shown in FIG. 2 is formed. This causes adverse impact on a subsequent chemical mechanical polishing (CMP) process. In addition, as a feature size of an integrated circuit process continuously decreases, it is increasingly difficult to obtain a defect-free high-flatness electroplated interconnection layer, and a requirement for a formula of an electroplating solution used for filling a small-sized groove is increasingly high. Therefore, it is necessary to provide an additive, where the additive can inhibit deposition of copper to some extent, to facilitate defect-free filling, and can make a surface of a plated layer develop toward flatness and evenness, to reduce a thickness difference between a copper layer in a high-density interconnection pattern region and a copper layer in a low-density interconnection pattern region, so that the subsequent CMP process can be easily performed. This can implement defect-free filling with high surface flatness.

SUMMARY

In view of this, an embodiment of the present disclosure provides a leveling agent. An electroplating composition using the leveling agent is used to fill an interconnection structure in an electronic substrate, so that defect-free metal filling of a small-sized hole or groove can be implemented, and a surface flatness of a metal plated layer obtained in distribution regions with different densities is high, and impurity content in the plated layer is low, thereby simplifying chemical mechanical polishing and improving reliability of the plated layer.

A first aspect of exemplary embodiments of the present disclosure provides a leveling agent, used for metal electroplating, where the leveling agent is a polypyridine compound, and the polypyridine compound includes the structural unit shown in Formula (I) or a protonated product of the structural unit shown in Formula (I)

Formula (I)

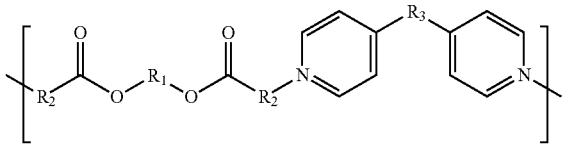

In Formula (I), $R_1$ and $R_2$ are independently any one of the following: substituted or unsubstituted alkylene, substituted or unsubstituted arylene, substituted or unsubstituted arylene alkyl, substituted or unsubstituted alkylene aryl, alkylene containing an ether oxygen atom, ester, and/or imide, arylene containing an ether oxygen atom, ester, and/or imide, arylene alkyl containing an ether oxygen atom, ester, and/or imide, and alkylene aryl containing an ether oxygen atom, ester, and/or imide; and $R_3$ is any one of the following: a single bond, substituted or unsubstituted alkylene, substituted or unsubstituted arylene, substituted or unsubstituted arylene alkyl, substituted or unsubstituted alkylene aryl, and a linking group containing an ether oxygen atom, ester, and/or imide. The leveling agent in this embodiment of the present disclosure is a polypyridine compound containing ester. The leveling agent is added to an electroplating composition, and is used to fill electroplating metal in a hole or groove in a semiconductor manufacturing process, so as to inhibit over-deposition of metal to some extent. In this way, it can be ensured that defect-free metal filling of the hole or groove is implemented, a relatively small-sized hole or groove is not fully filled in advance, and a thickness difference between electroplating metal layers in distribution regions with different densities is reduced, the platform undulation of the surface of the plated layer is significantly reduced, and a better flatness effect is obtained, which facilitates a subsequent CMP process. In addition, the impurity content in the plated layer is low, and the reliability of the plated layer is improved.

In an implementation of the present disclosure, the polypyridine compound includes a protonated product and a halide ion of the structural unit shown in Formula (I). In an implementation of the present disclosure, the halide ion includes any one of the following: a fluoride ion, a chloride ion, a bromide ion, and an iodide ion. The protonated product of the structural unit shown in Formula (I) may be represented as Formula (I-1). It may be understood that each substituted group in Formula (I-1) is consistent with a corresponding substituted group in Formula (I).

Formula (I-1)

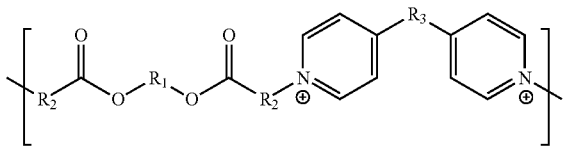

In an implementation of the present disclosure, in $R_1$, $R_2$, and $R_3$, a quantity of carbon atoms in the substituted or unsubstituted alkylene ranges from 1 to 30, and a quantity of carbon atoms in the substituted or unsubstituted arylene ranges from 6 to 30.

In some implementations of the present disclosure, $R_1$ may be alkylene containing one or more ether oxygen atoms, arylene containing one or more ether oxygen atoms, arylene alkyl containing one or more ether oxygen atoms, or alkylene aryl containing one or more ether oxygen atoms. $R_1$ is a group containing ether oxygen atoms, which can better inhibit over-deposition of metal, and reduce a thickness difference between electroplating metal layers in distribution regions with different densities, so as to obtain a better flatness effect.

In an implementation of the present disclosure, the alkylene containing an ether oxygen atom is denoted as $—(R_4O)_x\text{-}L\text{-}(R_{50})_y—R_5—$, where $R_4$ and $R_5$ are same or different alkylene, x is an integer greater than or equal to 0, y is an integer greater than or equal to 1, and L represents a single bond or at least one ether oxygen block.

In an implementation of the present disclosure, values of x and y may range from 1 to 300. In some embodiments, the values of x and y may range from 1 to 100. In some embodiments, the values of x and y may range from 1 to 30. A longer $R_1$ chain indicates a stronger inhibition effect on electroplating metal, and better leveling in a higher-density distribution region. Therefore, in this embodiment of the present disclosure, different $R_1$ chain lengths may be selected based on a distribution density in an application scenario.

In an implementation of the present disclosure, x is equal to 0, L represents a single bond, $R_5$ is ethylidene, and in this case, $R_1$ is represented as $—(CH_2CH_2O)_y—CH_2CH_2—$. In an implementation of the present disclosure, x is equal to 0, L represents a single bond, $R_5$ is isopropylidene, and in this case, $R_1$ is represented as $—(CH_2CHCH_2O)_y—CH_2CHCH_2—$. In an implementation of the present disclosure, x is an integer greater than or equal to 1, L represents a single bond, $R_4$ is ethylidene, and $R_5$ is isopropylidene. In this case, $R_1$ is represented as $—(CH_2CH_2O)_x—(CH_2CHCH_2O)_y—CH_2CHCH_2—$. In the foregoing embodiment, L represents a single bond. In some embodiments of the present disclosure, L may alternatively be at least one ether oxygen block. For example, in some embodiments, L is one ether oxygen block $—(R_{60})_k—$. In some embodiments, L is two ether oxygen blocks $—(R_{60})_k—(R_{70})_l—$, and k and l are integers greater than or equal to 1.

In an implementation of the present disclosure, in $R_3$, the linking group containing an ether oxygen atom, ester, and/or imide may be alkylene containing an ether oxygen atom, ester, and/or imide, arylene containing an ether oxygen atom, ester, and/or imide, arylene alkyl containing an ether oxygen atom, ester, and/or imide, or alkylene aryl containing an ether oxygen atom, ester, and/or imide.

A second aspect of embodiments of the present disclosure provides a preparation method for a leveling agent, including:

reacting, at a first temperature, a compound with hydroxyl at both ends shown in Formula (a) with a compound containing an acyl halide group shown in Formula (b), to obtain an intermediate; and then reacting, at a second temperature, the intermediate with a compound containing a bipyridine structure shown in Formula (c) to obtain a leveling agent, where the leveling agent includes a polypyridine compound, and the polypyridine compound includes a protonated product of a structural unit shown in Formula (I) or the structural unit shown in Formula (I).

Formula (a)

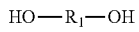

Formula (b)

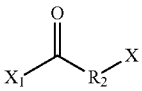

Formula (c)

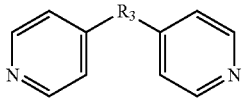

Formula (I)

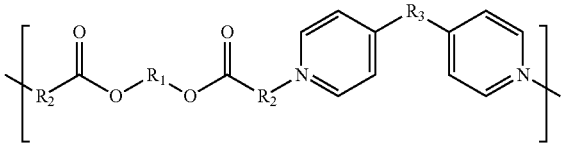

In Formula (a), $R_1$ is any one of the following: substituted or unsubstituted alkylene, substituted or unsubstituted arylene, substituted or unsubstituted arylene alkyl, substituted or unsubstituted alkylene aryl, alkylene containing an ether oxygen atom, ester, and/or imide, arylene containing an ether oxygen atom, ester, and/or imide, arylene alkyl containing an ether oxygen atom, ester, and/or imide, and alkylene aryl containing an ether oxygen atom, ester, and/or imide; in Formula (b), $X_1$ and X are same or different halide atoms; $R_2$ is any one of the following: substituted or unsubstituted alkylene, substituted or unsubstituted arylene, substituted or unsubstituted arylene alkyl, substituted or unsubstituted alkylene aryl, alkylene containing an ether oxygen atom, ester, and/or imide, arylene containing an ether oxygen atom, ester, and/or imide, arylene alkyl containing an ether oxygen atom, ester, and/or imide, and alkylene aryl containing an ether oxygen atom, ester, and/or imide; and in Formula (c), $R_3$ is any one of the following: a single bond, substituted or unsubstituted alkylene, substituted or unsubstituted arylene, substituted or unsubstituted arylene alkyl, substituted or unsubstituted alkylene aryl, and a linking group containing an ether oxygen atom, ester, and/or imide.

In Formula (I), $R_1$ and $R_2$ are independently any one of the following: substituted or unsubstituted alkylene, substituted or unsubstituted arylene, substituted or unsubstituted arylene alkyl, substituted or unsubstituted alkylene aryl, alkylene containing an ether oxygen atom, ester, and/or imide, arylene containing an ether oxygen atom, ester, and/or imide, arylene alkyl containing an ether oxygen atom, ester, and/or imide, and alkylene aryl containing an ether oxygen atom, ester, and/or imide; and $R_3$ is any one of the following: a single bond, substituted or unsubstituted alkylene, substituted or unsubstituted arylene, substituted or unsubstituted arylene alkyl, substituted or unsubstituted alkylene aryl, and a linking group containing an ether oxygen atom, ester, and/or imide.

It can be learned from the foregoing reaction process that $R_1$ in Formula (a) is the same as $R_1$ in Formula (I), $R_2$ in Formula (b) is the same as $R_2$ in Formula (I), and $R_3$ in Formula (c) is the same as $R_3$ in Formula (I). Details are not described herein again.

In an implementation of the present disclosure, the first temperature ranges from −20° C. to 25° C.

In an implementation of the present disclosure, the second temperature ranges from 25° C. to 200° C.

In some implementations of the present disclosure, the compound with hydroxyl at both ends shown in Formula (a) may have a structure shown in Formula (a-1), Formula (a-2), or Formula (a-3), where m and n in Formula (a-1), Formula (a-2), or Formula (a-3) are integers greater than or equal to 1.

Formula (a-1)

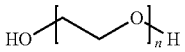

Formula (a-2)

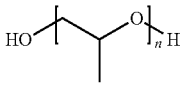

Formula (a-3)

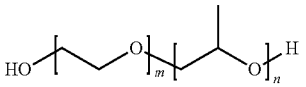

The preparation method for the leveling agent in this embodiment of the present disclosure requires a simple process, and is suitable for large-scale production.

A third aspect of embodiments of the present disclosure provides a composition, where the composition is an electroplating composition, the electroplating composition includes a metal ion source, and the leveling agent according to the first aspect of embodiments of the present disclosure or a leveling agent obtained by using the preparation method according to the second aspect of embodiments of the present disclosure.

In an implementation of the present disclosure, in the electroplating composition, a concentration of the leveling agent ranges from 1 ppm to 100 ppm. The concentration of the leveling agent in the electroplating composition is controlled to be in a proper range, which helps obtain a moderate metal deposition speed, and better implement defect-free high-flatness filling of small-sized holes or grooves on an entire substrate, thereby facilitating production of fine lines and improving reliability of an electronic product.

In an implementation of the present disclosure, the electroplating composition further includes one or more of the following: an accelerator, an inhibitor, or an inorganic additive. The leveling agent collaborates with the accelerator, the inhibitor, and the like to significantly reduce surface roughness of the copper layer. In regions with different distribution densities, the surface copper thickness can also be even, so that defect-free high-flatness filling can be implemented on the small-sized grooves on the entire substrate can be better implemented, thereby reducing technical difficulties of a subsequent polishing process.

In an implementation of the present disclosure, the accelerator includes one or more of the following: sodium 3-mercapto-1-propane sulfonate (MPS), sodium polydithiodipropane sulfonate (SPS), or N,N-dimethyldithiocarboxamidopropanesulfonate sodium (DPS); and a concentration of the accelerator in the electroplating composition ranges from 1 ppm to 50 ppm. Addition of the accelerator can accelerate deposition of the metal at the bottom of the groove and refine grains of the metal layer.

In an implementation of the present disclosure, the inhibitor includes one or more of the following: polyethylene glycol (PEG), polypropylene glycol (PPG), a block copolymer polyethylene oxide-polypropylene oxide-polyethylene oxide (PEO-PPO-PEO), a block copolymer polypropylene oxide-polyethylene oxide-polypropylene oxide (PPO-PEO-PPO), a random copolymer of polyoxyethylene (EO) and polyoxypropylene (PO), or a propylene glycol block polyether; and the concentration of the inhibitor in the electroplating composition ranges from 1 ppm to 2000 ppm. Addition of the inhibitor can inhibit rapid deposition of surface copper, prevent early sealing of holes or grooves, and also help obtain thinner surface copper after copper plating.

In an implementation of the present disclosure, the inorganic additive includes chloride ions, and a concentration of the chloride ions in the electroplating composition ranges from 1 ppm to 100 ppm. Addition of the chloride ions can make crystallization of the plated layer dense, fine, and not rough.

In an implementation of the present disclosure, the electroplating composition further includes at least one acid, and the at least one acid includes sulfuric acid and/or methyl sulfonate.

In an implementation of the present disclosure, a concentration of the at least one acid in the electroplating composition ranges from 1 g/L to 100 g/L. An appropriate acid system and acid concentration help obtain an appropriate electroplating deposition rate.

In an implementation of the present disclosure, the metal ion source includes any one of the following: a copper ion source, a nickel ion source, a tin ion source, a cobalt ion source, a ruthenium ion source, or a silver ion source. It may be understood that, if a type of metal layer is pre-deposited, the metal ion source in the electroplated composition correspondingly includes a metal ion source corresponding to a metal element in the pre-deposited metal layer.

In an implementation of the present disclosure, the copper ion source includes copper sulfate pentahydrate and/or copper methyl sulfonate; and a concentration of the copper ion source in the electroplating composition ranges from 1 g/L to 100 g/L in terms of copper ions. That the copper ion source is controlled to be in an appropriate range helps balance the deposition rate and brightness and flatness of an obtained copper plated layer.

A fourth aspect of embodiments of the present disclosure provides an application of the leveling agent according to the first aspect or a leveling agent obtained by using the preparation method according to the second aspect, or an application of the composition according to the third aspect in metal electroplating.

In an implementation of the present disclosure, the electroplating metal includes any one of the following: electroplating copper and copper alloy, electroplating nickel and nickel alloy, electroplating tin and tin alloy, electroplating cobalt and cobalt alloy, electroplating ruthenium and ruthenium alloy, or electroplating silver and silver alloy.

In an implementation of the present disclosure, the electroplating metal includes all electroplating metal used for filling a hole or groove on an electronic substrate. The electronic substrate may be a common substrate, a printed circuit board, a package substrate, or the like. The hole or groove includes a groove and/or a through hole, and the through hole may include a plated through hole, a blind via hole, and a buried via hole.

In an implementation of the present disclosure, the electroplating metal includes electroplating metal in a printed circuit board preparation process, electroplating metal in an integrated circuit metal interconnection process, or electroplating metal in an electronic packaging process. To illustrate, the electroplating metal may be electroplating metal in a process such as Damascus groove filling, silicon plated through hole filling, substrate redistribution, metal bump deposition, or hole or groove filling.

The leveling agent provided in this embodiment of the present disclosure is used for all-metal electroplating for filling holes or grooves on an electronic substrate, so as to implement defect-free filling of nano-level small-sized holes or grooves, and reduce a thickness difference between a high-density interconnection pattern region and a low-density interconnection pattern region of a copper interconnection layer, so that a surface of a plated layer is more flat and even, electroplating evenness of an entire electronic substrate is improved, and a subsequent CMP process is simplified. It is also conducive to production of fine lines, and the reliability of the electronic product is improved, so that a manufacturing requirement of a high-density interconnection product is better met through a simple process at low costs.

A fifth aspect of embodiments of the present disclosure provides a metal electroplating method, including the following operation: contacting the to-be-electroplated substrate with the composition according to the third aspect of embodiments of the present disclosure, and applying a current to the to-be-electroplated substrate to perform electroplating, so that a metal layer is formed on the to-be-electroplated substrate.

In an implementation of the present disclosure, a process condition of the electroplating is: an electroplating temperature ranges from 10° C. to 40° C., a current density in amps per square decimeter (ASD) from 0.5 ASD to 6 ASD, and an electroplating time ranges from 10 s to 200 s.

In an implementation of the present disclosure, the electroplating includes a first electroplating operation, a second electroplating operation, and a third electroplating operation, where in the first electroplating operation, a current density ranges from 0.2 ASD to 1 ASD, and an electroplating time ranges from is to 15 s; in the second electroplating operation, the current density ranges from 0.8 ASD to 2 ASD, and the electroplating time ranges from 10 s to 100 s; and in the third electroplating operation, the current density ranges from 2 ASD to 6 ASD, and the electroplating time ranges from 10 s to 100 s.

In an implementation of the present disclosure, a hole or groove is provided on the to-be-electroplated substrate, and the metal layer includes an intra-hole filling layer filled in the hole or groove and a surface deposition layer deposited around the hole or groove.

A sixth aspect of the present disclosure provides an electronic substrate, including a base layer and a metal layer disposed on the base layer, where the metal layer is formed by electroplating the composition according to the third aspect of embodiments of the present disclosure, or is formed by using the method according to the fifth aspect.

In an implementation of the present disclosure, the metal layer includes any one of the following: copper or a copper alloy layer, nickel or a nickel alloy layer, tin or a tin alloy layer, cobalt or a cobalt alloy layer, ruthenium or a ruthenium alloy layer, and silver or a silver alloy layer.

An embodiment of the present disclosure further provides an electronic apparatus, where the electronic apparatus includes the electronic substrate according to the sixth aspect of embodiments of the present disclosure.

BRIEF DESCRIPTION OF DRAWINGS

FIG. 6B is a partial enlarged view of FIG. 6A;

DESCRIPTION OF EMBODIMENTS

The following describes embodiments of the present disclosure with reference to accompanying drawings in embodiments of the present disclosure.

Figure 1A:
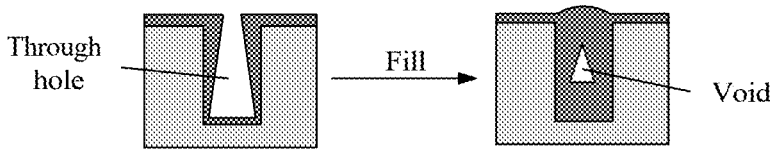
FIG. 1A is a diagram of a void defect formed by filling a hole or groove with electroplating copper.
Figure 1B:
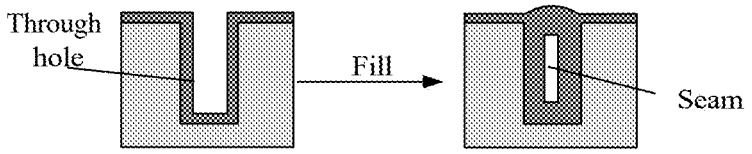
FIG. 1B is a diagram of a seam defect formed by filling a hole or groove with electroplating copper.
Figure 1C:
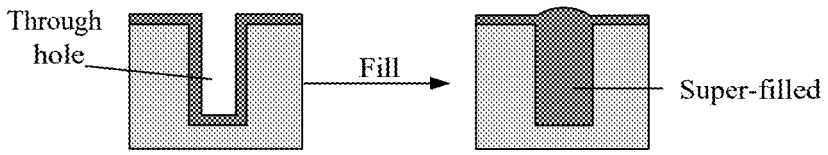
FIG. 1C is a diagram of super-filling formed by filling a hole or groove with electroplating copper.
Figure 2:
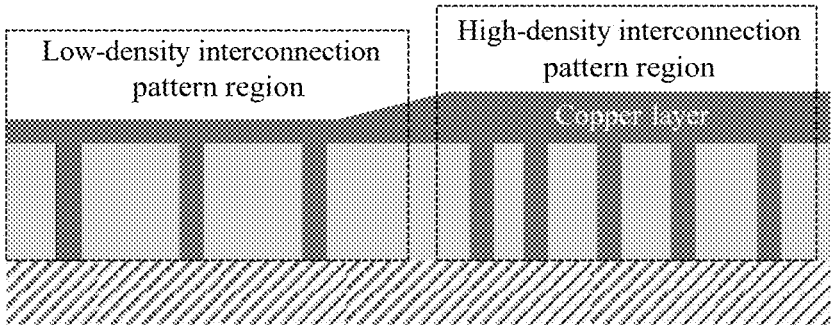
Prior Art FIG. 2
FIG. 2 is a diagram of forming a non-flat copper layer by filling a hole or groove with electroplating copper in the prior art.
Figure 3:
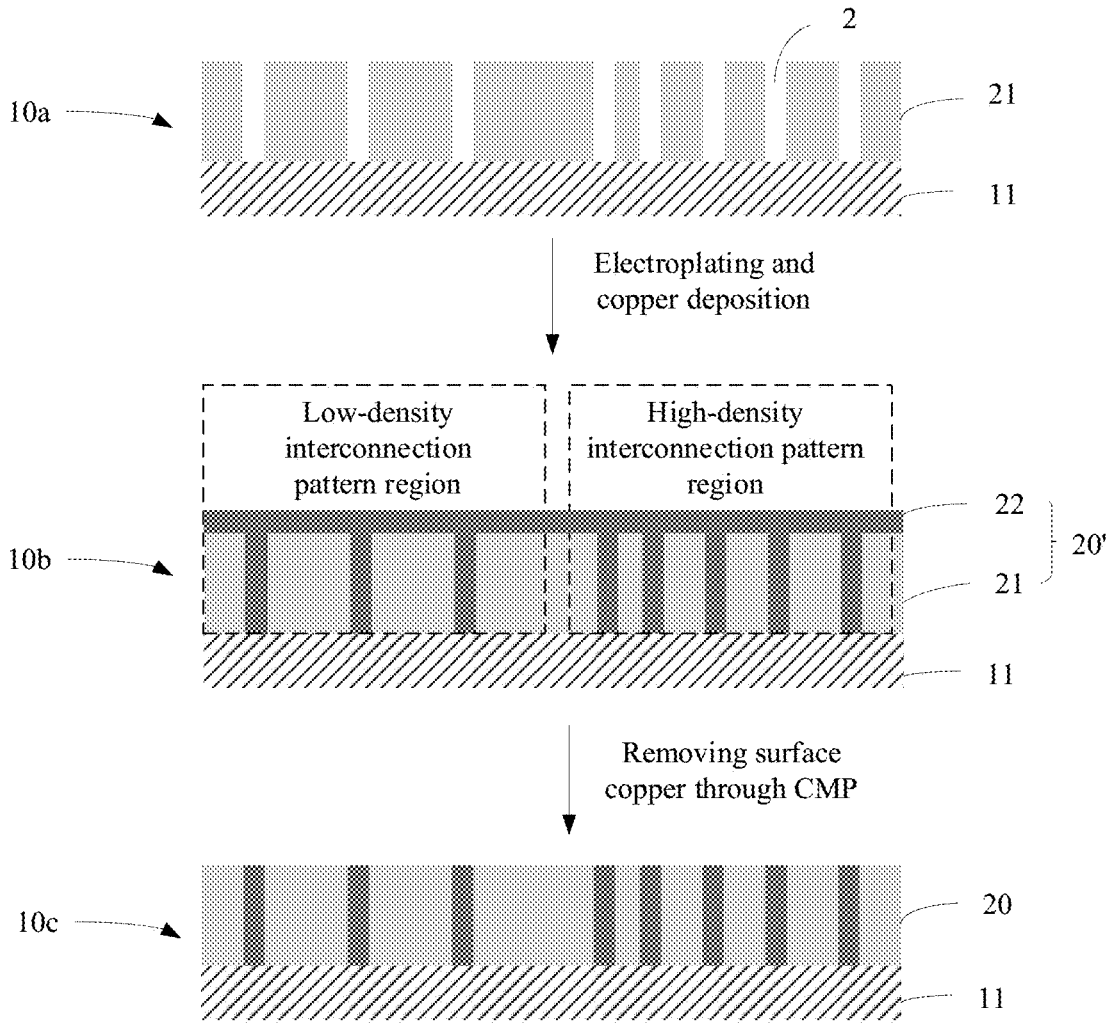
FIG. 3 is a diagram of a forming process of a copper interconnection layer in a semiconductor process.
Figure 4:
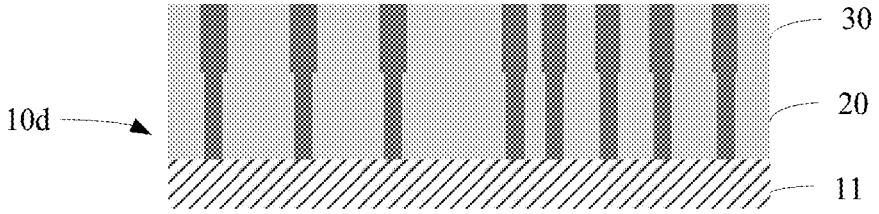
FIG. 4 is a diagram of a structure of a substrate having a plurality of copper interconnection layers.

FIG. 3 is a diagram of a forming process of a copper interconnection layer in a semiconductor process. In FIG. 3, 10*a* is a patterned substrate, where the patterned substrate 10*a* includes a substrate 11 and a patterned dielectric layer 21, and a plurality of grooves 2 are disposed at the patterned dielectric layer 21. After electroplating and copper deposition are performed on the patterned substrate 10*a*, a plurality of grooves 2 at the dielectric layer 21 are filled with copper to form a copper layer 22, and an electroplated substrate 10*b* is obtained. The copper layer 22 includes an intra-hole filling layer filled in the groove 2 and a surface deposition layer covering a surface of the dielectric layer 21. In the electroplated substrate 10*b*, the dielectric layer 21 and the copper layer 22 jointly form a copper interconnection layer 20' without being treated with CMP processing. After the surface deposition layer of the copper layer 22 is removed from the electroplated substrate 10*b* through CMP processing, the copper interconnection layer 20 treated with CMP processing is obtained, that is, the substrate 10*c* treated with CMP processing is obtained. As shown in FIG. 4, according to an actual requirement, the substrate 10*c* treated with CMP processing may be further prepared with a copper interconnection layer, for example, a copper interconnection layer 30 is formed at the copper interconnection layer 20, so as to obtain a substrate 10*d* having a plurality of copper interconnection layers. To improve reliability of the copper interconnection layer 20, an ideal case is that, as shown in FIG. 3, there is no defect such as a void or a seam in the hole filling layer in the groove 2. For ease of performing a CMP processing process, in an electroplating and copper deposition process, an ideal case is that the copper layer 22 is shown in the electroplated substrate 10*b* in FIG. 3. A thickness difference between the copper interconnection layer in the high-density interconnection pattern region and the copper interconnection layer in the low-density interconnection pattern region is small, a surface of the entire copper layer 22 is relatively flat, and an overall thickness of the copper layer 22 is relatively small. However, it is difficult to form a defect-free copper interconnection layer with high surface flatness by using a current formula of an electroplating solution, and defects such as voids and seams shown in FIG. 1A and FIG. 1B are likely to occur, or a problem that a thickness of a copper interconnection layer in a high-density interconnection pattern region shown in FIG. 2 differs greatly from a thickness of a copper interconnection layer in a low-density interconnection pattern region is likely to occur. The high-density interconnection pattern region is a region with a relatively high density (including a quantity of holes or grooves or a proportion of an area of all holes or grooves) of interconnection patterns (for example, holes or grooves) at an interconnection layer. The low-density interconnection pattern region is a region with a relatively low density of interconnection patterns (for example, holes or grooves) at an interconnection layer.

In addition, as precision of a semiconductor process is improved, a feature size of a device is decreasing, a distribution design is increasingly complex, and it is increasingly difficult to obtain a defect-free high-flatness copper interconnection layer. Therefore, a requirement for a formula of the electroplating solution used for filling a small-sized groove is increasingly strict. To implement defect-free filling on a small-sized groove, reduce a thickness difference between a high-density interconnection pattern region and a low-density interconnection pattern region at the copper interconnection layer, make a surface of a plated layer more flat and even, and simplify a subsequent CMP process, so as to implement defect-free filling with high surface flatness, an embodiment of the present disclosure provides a leveling agent. The leveling agent can inhibit metal deposition to some extent, so that defect-free high-flatness filling can be implemented on small-sized holes or grooves (including grooves and through holes).

The leveling agent provided in this embodiment of the present disclosure may be added to an electroplating solution as an additive for metal electroplating, where the leveling agent is a polypyridine compound, and the polypyridine compound includes the structural unit shown in Formula (I) or a protonated product of the structural unit shown in Formula (I).

Formula (I)

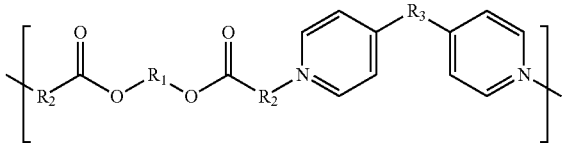

In Formula (I), $R_1$ and $R_2$ are independently any one of the following: substituted or unsubstituted alkylene, substituted or unsubstituted arylene, substituted or unsubstituted arylene alkyl, substituted or unsubstituted alkylene aryl, alkylene containing an ether oxygen atom, ester, and/or imide, arylene containing an ether oxygen atom, ester, and/or imide, arylene alkyl containing an ether oxygen atom, ester, and/or imide, and alkylene aryl containing an ether oxygen atom, ester, and/or imide; and $R_3$ is any one of the following: a single bond, substituted or unsubstituted alkylene, substituted or unsubstituted arylene, substituted or unsubstituted arylene alkyl, substituted or unsubstituted alkylene aryl, and a linking group containing an ether oxygen atom, ester, and/or imide.

The leveling agent in this embodiment of the present disclosure is a polypyridine compound containing ester. The leveling agent has a relatively good leveling effect. The leveling agent is added to an electroplating composition, and is used to fill electroplating metal in a hole or groove in a semiconductor manufacturing process, so as to inhibit over-deposition of metal to some extent. In this way, it can be ensured that defect-free metal filling of the hole or groove is implemented, a relatively small-sized hole or groove is not fully filled in advance, and a thickness difference between electroplating metal layers in distribution regions with different densities is reduced, platform undulation of the surface of the plated layer is significantly reduced, and a better flatness effect is obtained, which facilitates the subsequent CMP process. A polymer in the leveling agent in this embodiment of the present disclosure has a stable molecular structure, so that the impurity content in the obtained plated layer is low, and reliability of the plated layer is improved.

In an implementation of the present disclosure, the polypyridine compound includes a protonated product and a halide ion of the structural unit shown in Formula (I), that is, the polypyridine compound includes the structural unit shown in Formula (II), and the halide ion includes any one of the following: a fluoride ion, a chloride ion, a bromide ion, and an iodide ion. The protonated product of the structural unit shown in Formula (I) may be represented as Formula (I-1). It may be understood that each substituted group in Formula (I-1) and Formula (II) is consistent with a corresponding substituted group in Formula (I). In Formula (II), $X^-$ is a halide ion. In some embodiments, the two $X^-$ in Formula (I) are a same halide ion, so as to facilitate preparation of the leveling agent.

Formula (I-1)

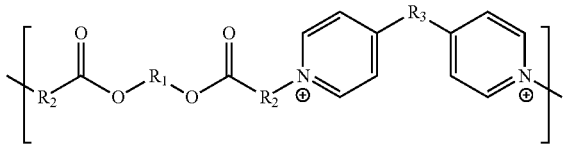

Formula (II)

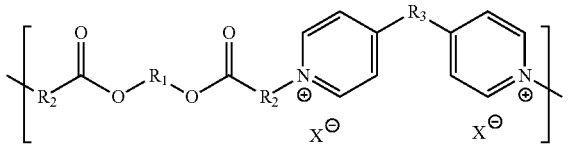

In an implementation of the present disclosure, in $R_1$, $R_2$, and $R_3$, a quantity of carbon atoms in the substituted or unsubstituted alkylene may range from 1 to 30. In some embodiments, the quantity of carbon atoms in the substituted or unsubstituted alkylene may be 1, 2, 3, 4, 5, 6, 7, 8, 9, 10, 11, 12, 13, 14, 15, 16, 17, 18, 19, 20, 21, 22, 23, 24, 25, 26, 27, 28, 29, or 30. For example, $R_1$, $R_2$, and $R_3$ may be substituted or unsubstituted methylene, substituted or unsubstituted ethylidene, substituted or unsubstituted propilidene, substituted or unsubstituted isopropylidene, substituted or unsubstituted butylidene, substituted or unsubstituted isobutylidene, substituted or unsubstituted neopentylene, or substituted or unsubstituted hexylidene.

In an implementation of the present disclosure, in $R_1$, $R_2$, and $R_3$, a quantity of carbon atoms in the substituted or unsubstituted arylene may range from 6 to 30. In some embodiments, the quantity of carbon atoms in the substituted or unsubstituted arylene may be 6, 7, 8, 9, 10, 11, 12, 13, 14, 15, 16, 17, 18, 19, 20, 21, 22, 23, 24, 25, 26, 27, 28, 29, or 30. For example, R1, R2, and R3 may be substituted or unsubstituted benzene, substituted or unsubstituted biphenylene, substituted or unsubstituted terphenyl, substituted or unsubstituted fluorenylidene, substituted or unsubstituted naphthalene, or substituted or unsubstituted anthracene.

In an implementation of the present disclosure, in $R_1$, $R_2$, and $R_3$, a quantity of carbon atoms in the substituted or unsubstituted arylene alkyl may range from 7 to 40. In some embodiments, the quantity of carbon atoms in the substituted or unsubstituted arylene alkyl may be 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, or 40. In an implementation of the present disclosure, in $R_1$, $R_2$, and $R_3$, a quantity of carbon atoms in the substituted or unsubstituted alkylene aryl may range from 7 to 40. In some embodiments, the quantity of carbon atoms in the substituted or unsubstituted alkylene aryl may be 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, or 40.

In an implementation of the present disclosure, in $R_1$, $R_2$ and $R_3$, substituted groups in the substituted alkylene, the substituted arylene, the substituted arylene alkyl, and the substituted alkylene aryl may be but not limited to halide atoms.

In an implementation of the present disclosure, in $R_1$, a quantity of carbon atoms in the alkylene containing an ether oxygen atom, ester, and/or imide may range from 2 to 30, and the quantity of carbon atoms is, for example, 2, 3, 4, 5, 6, 7, 8, 9, 10, 11, 12, 13, 14, 15, 16, 17, 18, 19, 20, 21, 22, 23, 24, 25, 26, 27, 28, 29, or 30; the quantity of carbon atoms in the arylene containing an ether oxygen atom, ester, and/or imide may range from 6 to 30, and the quantity of carbon atoms is, for example, 6, 7, 8, 9, 10, 11, 12, 13, 14, 15, 16, 17, 18, 19, 20, 21, 22, 23, 24, 25, 26, 27, 28, 29, or 30; the quantity of carbon atoms in the arylene alkyl containing an ether oxygen atom, ester, and/or imide may range from 7 to 40, and the quantity of carbon atoms is, for example, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, or 40; and the quantity of carbon atoms in the alkylene aryl containing an ether oxygen atom, ester, and/or imide may range from 7 to 40, and the quantity of carbon atoms is, for example, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, or 40. The alkylene containing an ether oxygen atom, ester, and/or imide is alkylene containing any one or more of the following: an ether oxygen atom, ester, or imide; the arylene containing an ether oxygen atom, ester, and/or imide is arylene containing any one or more of the following: an ether oxygen atom, ester, or imide; the arylene alkyl containing an ether oxygen atom, ester, and/or imide is arylene alkyl containing any one or more of the following: an ether oxygen atom, ester, or imide; and the alkylene aryl containing an ether oxygen atom, ester, and/or imide is alkylene aryl containing any one or more of the following: an ether oxygen atom, ester, or imide.

In some implementations of the present disclosure, $R_1$ may be alkylene containing one or more ether oxygen atoms, arylene containing one or more ether oxygen atoms, arylene alkyl containing one or more ether oxygen atoms, or alkylene aryl containing one or more ether oxygen atoms. $R_1$ is a group containing ether oxygen atoms, which can better inhibit over-deposition of metal, and reduce a thickness difference between electroplating metal layers in distribution regions with different densities, so as to obtain a better flatness effect.

In some implementations of the present disclosure, $R_1$ may be alkylene containing an ether oxygen atom, and the alkylene containing an ether oxygen atom may be represented as $—(R_4O)_x\text{-}L\text{-}(R_{50})_y—R_5—$, where $R_4$ and $R_5$ may be same or different alkylene, x is an integer greater than or equal to 0, y is an integer greater than or equal to 1, and L represents a single bond or at least one ether oxygen block. $R_4$ and $R_5$ may be alkylene with 2 to 10 carbon atoms, for example, may be ethylidene, propilidene, or isopropylidene. Values of x and y may range from 1 to 300. In some embodiments, the values of x and y may range from 1 to 100. In some embodiments, the values of x and y may range from 1 to 30. In some embodiments, the values of x and y may be 1, 2, 3, 4, 5, 6, 7, 8, 9, 10, 11, 12, 13, 14, 15, 16, 17, 18, 19, 20, 21, 22, 23, 24, 25, 26, 27, 28, 29, or 30. A longer $R_1$ chain indicates a stronger inhibition effect on electroplating metal, and better leveling in a higher-density distribution region. Therefore, in this embodiment of the present disclosure, different $R_1$ chain lengths may be selected based on a distribution density in an application scenario.

In an implementation of the present disclosure, x is equal to 0, L represents a single bond, $R_5$ is ethylidene, and in this case, $R_1$ is represented as $—(CH_2CH_2O)_y—CH_2CH_2—$. In an implementation of the present disclosure, x is equal to 0, L represents a single bond, $R_5$ is isopropylidene, and in this case, $R_1$ is represented as $—(CH_2CHCH_2O)_y—CH_2CHCH_2—$. In an implementation of the present disclosure, x is an integer greater than or equal to 1, L represents a single bond, $R_4$ is ethylidene, and $R_5$ is isopropylidene. In this case, $R_1$ is represented as $—(CH_2CH_2O)_x—(CH_2CHCH_2O)_y—CH_2CHCH_2—$. In the foregoing embodiment, L represents a single bond. In some embodiments of the present disclosure, L may alternatively be at least one ether oxygen block. For example, in some embodiments, L is one ether oxygen block —$(R_{60})_k$—. In some embodiments, L is two ether oxygen blocks —$(R_{60})_k$—$(R_{70})_l$—, and k and l are integers greater than or equal to 1.

In an implementation of the present disclosure, in $R_3$, the linking group containing an ether oxygen atom, ester, and/or imide may be alkylene containing an ether oxygen atom, ester, and/or imide, arylene containing an ether oxygen atom, ester, and/or imide, arylene alkyl containing an ether oxygen atom, ester, and/or imide, or alkylene aryl containing an ether oxygen atom, ester, and/or imide. The selection of the foregoing groups is the same as that of $R_1$ and $R_2$, and details are not described herein again. In some embodiments, the linking group containing imide may be —HN—C(=O)—R—C(=O)—NH—, and R may be substituted or unsubstituted alkylene.

In some embodiments of the present disclosure, the polypyridine compound includes only a protonated product and a halide ion of the structural unit shown in Formula (I), and the polypyridine compound is represented as a polypyridine salt compound shown in Formula (1):

Formula (1)

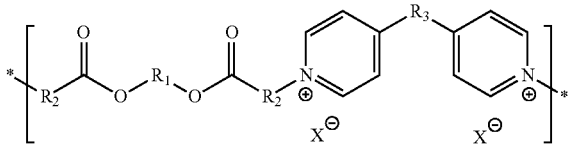

where in Formula (1), n is an integer greater than or equal to 2. In some embodiments, n may be, for example, an integer ranging from 2 to 15. In embodiments, n may be 2, 3, 4, 5, 6, 7, 8, 9, 10, 11, 12, 13, 14, or 15.

Correspondingly, an embodiment of the present disclosure further provides a preparation method for a leveling agent, including:

Operation S101: React, at a first temperature, a compound with hydroxyl at both ends shown in Formula (a) and a compound containing an acyl halide group shown in Formula (b), to obtain an intermediate.

Operation S102: React, at a second temperature, the intermediate and a compound containing a bipyridine structure shown in Formula (c) to obtain a leveling agent, where the leveling agent includes a polypyridine compound, and the polypyridine compound includes a protonated product of a structural unit shown in Formula (I) or the structural unit shown in Formula (I).

Formula (a)

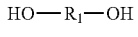

Formula (b)

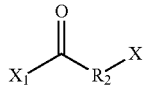

Formula (c)

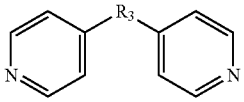

-continued

Formula (I)

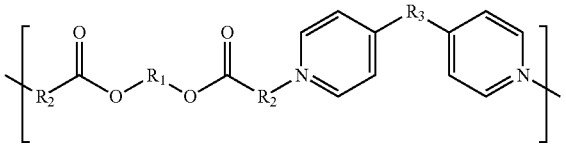

In Formula (a), $R_1$ is any one of the following: substituted or unsubstituted alkylene, substituted or unsubstituted arylene, substituted or unsubstituted arylene alkyl, substituted or unsubstituted alkylene aryl, alkylene containing an ether oxygen atom, ester, and/or imide, arylene containing an ether oxygen atom, ester, and/or imide, arylene alkyl containing an ether oxygen atom, ester, and/or imide, and alkylene aryl containing an ether oxygen atom, ester, and/or imide; in Formula (b), $X_1$ and X are same or different halide atoms; $R_2$ is any one of the following: substituted or unsubstituted alkylene, substituted or unsubstituted arylene, substituted or unsubstituted arylene alkyl, substituted or unsubstituted alkylene aryl, alkylene containing an ether oxygen atom, ester, and/or imide, arylene containing an ether oxygen atom, ester, and/or imide, arylene alkyl containing an ether oxygen atom, ester, and/or imide, and alkylene aryl containing an ether oxygen atom, ester, and/or imide; and in Formula (c), $R_3$ is any one of the following: a single bond, substituted or unsubstituted alkylene, substituted or unsubstituted arylene, substituted or unsubstituted arylene alkyl, substituted or unsubstituted alkylene aryl, and a linking group containing an ether oxygen atom, ester, and/or imide.

In Formula (I), $R_1$ and $R_2$ are independently any one of the following: substituted or unsubstituted alkylene, substituted or unsubstituted arylene, substituted or unsubstituted arylene alkyl, substituted or unsubstituted alkylene aryl, alkylene containing an ether oxygen atom, ester, and/or imide, arylene containing an ether oxygen atom, ester, and/or imide, arylene alkyl containing an ether oxygen atom, ester, and/or imide, and alkylene aryl containing an ether oxygen atom, ester, and/or imide; and $R_3$ is any one of the following: a single bond, substituted or unsubstituted alkylene, substituted or unsubstituted arylene, substituted or unsubstituted arylene alkyl, substituted or unsubstituted alkylene aryl, and a linking group containing an ether oxygen atom, ester, and/or imide.

It can be learned from the foregoing reaction process that $R_1$ in Formula (a) is the same as $R_1$ in Formula (I), $R_2$ in Formula (b) is the same as $R_2$ in Formula (I), and $R_3$ in Formula (c) is the same as $R_3$ in Formula (I). Details are not described herein again.

In some implementations of the present disclosure, the polypyridine compound includes a structural unit shown in Formula (II), where $X^-$ is a halide ion.

Formula (II)

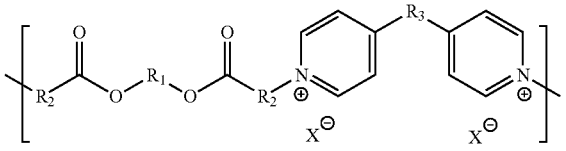

$X^-$ in Formula (II) is derived from the halide atom X in Formula (b).

In some implementations of the present disclosure, the compound with hydroxyl at both ends shown in Formula (a) may have a structure shown in Formula (a-1), Formula (a-2), or Formula (a-3), where m and n in Formula (a-1), Formula (a-2), or Formula (a-3) are integers greater than or equal to 1, for example, may range from 1 to 300. In some embodiments, values of m and n may be 1, 2, 3, 4, 5, 6, 7, 8, 9, 10, 11, 12, 13, 14, 15, 16, 17, 18, 19, 20, 21, 22, 23, 24, 25, 26, 27, 28, 29, or 30.

Formula (a-1)

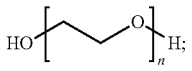

Formula (a-2)

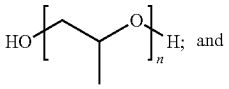

Formula (a-3)

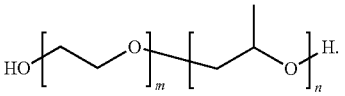

In an implementation of the present disclosure, in operation S101, the first temperature may range from −20° C. to 25° C. In some embodiments, the first temperature may range from 0° C. to 10° C. In the reaction process of operation S101, dichloromethane or the like may be used as a solvent.

In an implementation of the present disclosure, in operation S102, the second temperature may range from 25° C. to 200° C. In some embodiments, the second temperature may range from 50° C. to 150° C.

The polypyridine compound prepared in this embodiment of the present disclosure is a solid.

An embodiment of the present disclosure further provides an electroplating composition, where the electroplating composition includes a metal ion source and the foregoing leveling agent in embodiments of the present disclosure. The electroplating composition may be used as an electroplating solution for electroplating and deposition of the metal layer.

In an implementation of the present disclosure, in the electroplating composition, a concentration of the leveling agent ranges from 1 ppm to 100 ppm. In some embodiments, the concentration of the leveling agent ranges from 2 ppm to 80 ppm. In some embodiments, the concentration of the leveling agent ranges from 5 ppm to 50 ppm. In some embodiments, the concentration of the leveling agent ranges from 10 ppm to 30 ppm. In some embodiments, the concentration of the leveling agent may be 1 ppm, 2 ppm, 5 ppm, 8 ppm, 10 ppm, 12 ppm, 15 ppm, 18 ppm, 20 ppm, 25 ppm, 30 ppm, 40 ppm or 50 ppm. The concentration of the leveling agent in the electroplating composition is controlled to be in a proper range, which helps obtain a moderate metal deposition speed, and better implement defect-free high-flatness filling of small-sized holes or grooves on an entire substrate, thereby facilitating production of fine lines and improving reliability of an electronic product.

In an implementation of the present disclosure, the electroplating composition further includes one or more of the following: an accelerator, an inhibitor, or an inorganic additive. The leveling agent collaborates with the accelerator, the inhibitor, and the like to significantly reduce surface roughness of the copper layer. In regions with different distribution densities, the surface copper thickness can also be even, so that defect-free high-flatness filling can be implemented on the small-sized holes or grooves on the entire substrate can be better implemented, thereby reducing technical difficulties of a subsequent polishing process.

In an implementation of the present disclosure, the accelerator includes one or more of the following: sodium 3-mercapto-1-propane sulfonate (MPS), sodium polydithiodipropane sulfonate (SPS), or N,N-dimethyldithiocarboxamidopropanesulfonate sodium (DPS). Addition of the accelerator can accelerate deposition of the metal at the bottom of the groove and refine grains of the metal layer. In an implementation of the present disclosure, a concentration of the accelerator in the electroplating composition may range from 1 ppm to 50 ppm. In some implementations, the concentration of the accelerator in the electroplating composition may range from 2 ppm to 40 ppm. In some implementations, the concentration of the accelerator in the electroplating composition may range from 5 ppm to 35 ppm. In some implementations, the concentration of the accelerator in the electroplating composition may range from 10 ppm to 30 ppm.

In an implementation of the present disclosure, the inhibitor includes one or more of the following: polyethylene glycol (PEG), polypropylene glycol (PPG), a block copolymer PEO-PPO-PEO, a block copolymer PPO-PEO-PPO, a random copolymer of EO and PO, or a propylene glycol block polyether. Addition of the inhibitor can inhibit rapid deposition of surface copper, prevent early sealing of holes or grooves, and also help obtain thinner surface copper after copper plating. In an implementation of the present disclosure, a concentration of the inhibitor in the electroplating composition may range from 1 ppm to 2000 ppm. In some implementations, the concentration of the inhibitor in the electroplating composition ranges from 10 ppm to 1000 ppm. In some implementations, the concentration of the inhibitor in the electroplating composition ranges from 100 ppm to 1000 ppm. In some implementations, the concentration of the inhibitor in the electroplating composition ranges from 150 ppm to 500 ppm.

In an implementation of the present disclosure, the inorganic additive includes chloride ions, and a concentration of the chloride ions in the electroplating composition ranges from 1 ppm to 100 ppm. In some implementations, the concentration of chloride ions in the electroplating composition may be 1 ppm, 5 ppm, 10 ppm, 20 ppm, 30 ppm, 40 ppm, 50 ppm, 60 ppm, 70 ppm, 80 ppm, 90 ppm or 100 ppm. Addition of the chloride ions can make crystallization of the plated layer dense, fine, and not rough.

In an implementation of the present disclosure, the electroplating composition further includes at least one acid, and the at least one acid includes sulfuric acid and/or methyl sulfonate. In an implementation of the present disclosure, a concentration of the at least one acid in the electroplating composition ranges from 1 g/L to 100 g/L. In some implementations, the concentration of the at least one acid in the electroplating composition may be, for example, 1 g/L, 10 g/L, 20 g/L, 30 g/L, 40 g/L, 50 g/L, 55 g/L, 60 g/L, 70 g/L, 80 g/L, 90 g/L, or 100 g/L. An appropriate acid system and acid concentration help obtain an appropriate electroplating deposition rate.

In an implementation of the present disclosure, the metal ion source includes any one of the following: a copper ion source, a nickel ion source, a tin ion source, a cobalt ion source, a ruthenium ion source, or a silver ion source. It may be understood that, if a type of metal layer is pre-deposited, the metal ion source in the electroplated composition correspondingly includes a metal ion source corresponding to a metal element in the pre-deposited metal layer. For example, if a metallic copper layer is pre-deposited, the metal ion source includes a copper ion source.

In an implementation of the present disclosure, the copper ion source includes copper sulfate pentahydrate and/or copper methyl sulfonate. When electroplating is performed by using an acid system of the copper ion source, current efficiency is high, environmental friendliness is ensured, and filling of blind via holes can be better implemented through collaboration between various additives. In an implementation of the present disclosure, a concentration of a copper ion source in the electroplating composition ranges from 1 g/L to 100 g/L in terms of copper icons. In some implementations, the concentration of the copper ion source in the electroplating composition may be, for example, 1 g/L, 10 g/L, 20 g/L, 30/L, 40 g/L, 50 g/L, 60 g/L, 70 g/L, 80 g/L, 90 g/L, or 100 g/L in terms of copper icons. That the copper ion source is controlled to be in an appropriate range helps balance the deposition rate and brightness and flatness of an obtained copper plated layer.

The new leveling agent provided in this embodiment of the present disclosure is applied to a metal electroplating solution such as a copper electroplating solution, so that a sample with an even surface copper thickness and a good appearance of the substrate surface can be obtained in a process of filling holes or grooves. Therefore, the leveling agent is suitable for precision machining. In addition, an operation window of the leveling agent in this embodiment of the present disclosure is wide. For holes or grooves with a size ranging from 28 nm to 1.2 μm, the holes or grooves of all sizes can be filled without a seam, thereby improving reliability of a final product.

An embodiment of the present disclosure further provides an application of the leveling agent and/or the electroplating composition in a metal electroplating process. In the application, the electroplating metal may be any one of the following: electroplating copper and copper alloy, electroplating nickel and nickel alloy, electroplating tin and tin alloy, electroplating cobalt and cobalt alloy, electroplating ruthenium and ruthenium alloy, or electroplating silver and silver alloy.

In an implementation of the present disclosure, the electroplating metal includes electroplating metal in a printed circuit board preparation process, electroplating metal in an integrated circuit metal interconnection process, or electroplating metal in an electronic packaging process. For example, the electroplating metal may be electroplating metal in a process such as Damascus groove filling, silicon plated through hole filling, substrate redistribution, metal bump deposition, or through hole filling.

In an implementation of the present disclosure, the electroplating metal includes all electroplating metal used for filling a hole or groove on an electronic substrate. The electronic substrate may be a common substrate, a printed circuit board, a package substrate, or the like. The hole or groove includes a groove and/or a through hole, and the through hole may include a plated through hole, a blind via hole, and a buried via hole. The all-metal filling may be filling electroplating copper and copper alloy, electroplating nickel and nickel alloy, electroplating tin and tin alloy, electroplating cobalt and cobalt alloy, electroplating ruthenium and ruthenium alloy, or electroplating silver and silver alloy.

The leveling agent provided in this embodiment of the present disclosure is used for all-metal electroplating for filling holes or grooves on an electronic substrate, so as to implement defect-free filling of nano-level small-sized holes or grooves, and reduce a thickness difference between a high-density interconnection pattern region and a low-density interconnection pattern region of a copper interconnection layer, so that a surface of a plated layer is more flat and even, electroplating evenness of an entire electronic substrate is improved, and a subsequent CMP process is simplified. It is also conducive to production of fine lines, and the reliability of the electronic product is improved, so that a manufacturing requirement of a high-density interconnection product is better met through a simple process at low costs.

An embodiment of the present disclosure further provides a metal electroplating method, including the following operation: contacting the to-be-electroplated substrate with the foregoing electroplating composition in embodiments of the present disclosure, and applying a current to the to-be-electroplated substrate to perform electroplating, so that a metal layer is formed on the to-be-electroplated substrate.

The to-be-electroplated substrate may be immersed into the electroplating composition as a cathode, and the electroplating composition, that is, the electroplating solution, is used as an electrolyte, and forms a conductive loop together with the soluble or insoluble anode, thereby implementing metal deposition on the to-be-electroplated substrate.

In an implementation of the present disclosure, a hole or groove is provided on the to-be-electroplated substrate, and the metal layer includes an intra-hole filling layer filled in the hole or groove and a surface deposition layer deposited around the hole or groove. The hole or groove includes a groove and/or a through hole, and the through hole may include one or more of the following: a plated through hole, a blind via hole, or a buried via hole.

In an implementation of the present disclosure, a horizontal size of the hole or groove may range from 28 nm to 1.2 μm, and a depth thereof may range from 100 nm to 300 nm. For example, the horizontal size of the hole or groove may be 28 nm, 30 nm, 35 nm, 40 nm, 45 nm, 50 nm, 60 nm, 70 nm, 80 nm, 90 nm, 100 nm, 200 nm, 300 nm, 400 nm, 500 nm, 600 nm, 700 nm, 800 nm, 900 nm, 1.0 μm, 1.1 μm, or 1.2 μm. The depth may be, for example, 100 nm, 200 nm, or 300 nm. The holes or grooves on the to-be-electroplated substrate may have different horizontal sizes and different depths. The horizontal size of the groove is a width of the groove, and the horizontal size of the through hole is a diameter of the through hole.

In an implementation of the present disclosure, regions with different hole or groove distribution densities may be disposed on the to-be-electroplated substrate, for example, including a high-density hole or groove distribution region and a low-density hole or groove distribution region.

Generally, before electroplating is performed, metallization processing is performed on the inner wall of the hole or groove, for example, a metal seed layer, such as a copper seed layer, is chemically plated on the inner wall of the hole or groove.

In an implementation of the present disclosure, a process condition of the electroplating is: an electroplating temperature ranges from 10° C. to 40° C., a current density ranges from 0.5 ASD to 6 ASD, and an electroplating time ranges from 10 s to 200 s.

In an implementation of the present disclosure, the electroplating includes a first electroplating operation, a second electroplating operation, and a third electroplating operation, where in the first electroplating operation, a current density ranges from 0.2 ASD to 1 ASD, and an electroplating time ranges from is to 15 s; in the second electroplating operation, the current density ranges from 0.8 ASD to 2 ASD, and the electroplating time ranges from 10 s to 100 s; and in the third electroplating operation, the current density ranges from 2 ASD to 6 ASD, and the electroplating time ranges from 10 s to 100 s. In this embodiment of the present disclosure, through operation-by-operation electroplating, defect-free filling can be better implemented, and an appropriate thickness of the surface metal layer can be obtained. Copper electroplating is used as an example. The first electroplating operation can better repair the copper seed layer; the second electroplating operation can better implement seam filling; and the third electroplating operation can thicken the surface to facilitate subsequent polishing and grinding.

Figure 5:
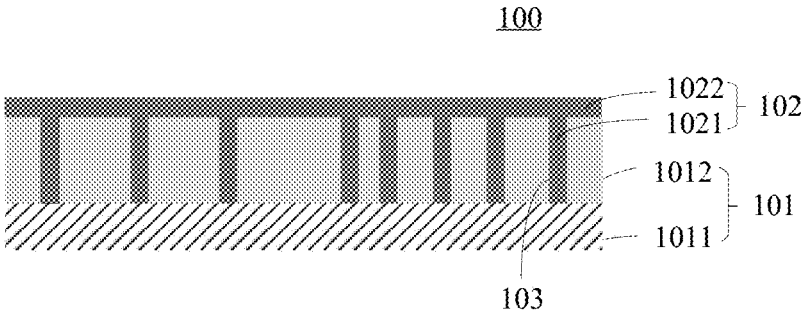
FIG. 5 is a diagram of a structure of an electronic substrate 100 according to an embodiment of the present disclosure.

Refer to FIG. 5. An embodiment of the present disclosure further provides an electronic substrate 100, including a base layer 101 and a metal layer 102 disposed on the base layer. The metal layer 102 is formed through electroplating by using the foregoing electroplating composition in embodiments of the present disclosure, or is formed by using the foregoing metal electroplating method in embodiments of the present disclosure.

In an implementation of the present disclosure, the metal layer 102 includes any one of the following: copper or a copper alloy layer, nickel or a nickel alloy layer, tin or a tin alloy layer, cobalt or a cobalt alloy layer, ruthenium or a ruthenium alloy layer, and silver or a silver alloy layer.

In an implementation of the present disclosure, the base layer 101 includes a substrate 1011 and a dielectric layer 1012, a hole or groove 103 is provided at the base layer 101, and the metal layer 102 includes an intra-hole filling layer 1021 for filling the hole or groove 103 and a surface deposition layer 1022 deposited around the hole or groove 103. It may be understood that, in some implementations, after the surface deposition layer 1022 is removed through the CMP processing process, the metal layer 102 includes only the intra-hole filling layer 1021 for filling the hole or groove 103.

In an implementation of the present disclosure, a metal seed layer, for example, a copper seed layer, formed by performing metallization processing on the hole or groove 103 may be further included between the base layer 101 and the metal layer 102.

In an implementation of the present disclosure, a horizontal size of the hole or groove 103 may range from 28 nm to 1.2 μm, and a depth thereof may range from 100 nm to 300 nm. A plurality of holes or grooves 103 may be provided at the base layer 101, and the plurality of holes or grooves 103 may have different horizontal sizes and different depths, or may have a same horizontal size and a same depth.

In an implementation of the present disclosure, a thickness of the surface deposition layer 1022 is less than 8 μm. In an implementation of the present disclosure, a ratio of an average thickness H1 of the surface deposition layer 1022 of the high-density interconnection pattern region to an average thickness H2 of the surface deposition layer 1022 of the low-density interconnection pattern region is less than or equal to 1.7. In some embodiments, the ratio of H1 to H2 is less than or equal to 1.5. In some embodiments, the ratio of H1 to H2 is less than or equal to 1.3. In some embodiments, the ratio of H1 to H2 is less than or equal to 1.1.

It may be understood that FIG. 5 in this embodiment of the present disclosure is a diagram of a structure of an electronic substrate 100 without being treated with CMP processing. In an actual application, the surface deposition layer 1022 is removed by using a polishing process.

An embodiment of the present disclosure further provides an electronic apparatus, and the electronic apparatus uses the foregoing electronic substrate 100 in embodiments of the present disclosure.

Embodiments of the present disclosure are further described below by using a plurality of embodiments.

Embodiment 1

A polypyridine compound A shown in Formula (1):

Formula (1)

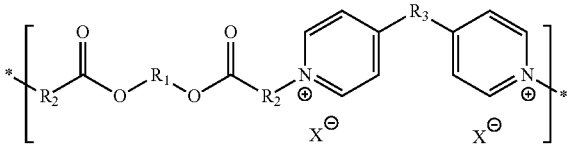

$R_1$ is

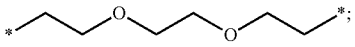

$R_2$ is

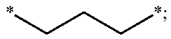

and $R_3$ has a single bond, $X^-$ is $Cl^-$, n is 4, and * indicates a linking position.

The preparation method for the polypyridine compound A is as follows:

(1) Add 50 mL of dichloromethane, 20 mmol of triethylene glycol, and 40 mmol of triethylamine to a three-neck flask provided with a thermometer, a mixer, and a constant-pressure drip funnel, start the mixer, and control the temperature to range from 0° C. to 10° C.

(2) Dissolve 40 mmol of 4-chlorobutyryl chloride in dichloromethane, and transfer the obtained solution to the constant-pressure drip funnel, so that the 4-chlorobutyryl chloride solution drips slowly at a speed of 1 mL/min at a temperature of 0° C. to 10° C. After the dripping is complete, make the reaction last for more than 12 hours at a room temperature. Then, evaporate the reaction mixture to remove the dichloromethane, and then dissolve the obtained solution by using ethyl acetate and water, to extract the organic phase of ethyl acetate, and then evaporate the obtained solution after washing with water, to obtain an intermediate of the ester.

(3) Add 20 mmol of the obtained intermediate of the ester and 20 mmol of 4,4'-bipyridine to a round-bottom flask provided with a mixer, start the mixer, and increase the temperature to 120° C.; and after 12 hours of reaction, decrease the temperature to the room temperature, to obtain the final polypyridine compound A in solid state.

A copper electroplating solution includes components at the following mass ratios:

Copper sulfate pentahydrate (in terms of copper ions): 50 g/L

Sulfuric acid: 50 g/L

Chloride ion: 50 ppm

Polypyridine compound A: 10 ppm

Accelerator sodium polydithiodipropane sulfonate_ (SPS): 25 ppm

Inhibitor L64 (propylene glycol block polyether): 300 ppm.

To reflect an effect of the leveling agent provided in this embodiment of the present disclosure, the copper electroplating solution to which the leveling agent is not added is used as a comparative example. A difference between the copper electroplating solution in the comparative example and that in Embodiment 1 lies only in that the polypyridine compound A is not added.

The copper electroplating solution in Embodiment 1 and the copper electroplating solution in the comparative example are separately used to perform electroplating copper filling on the to-be-electroplated substrate with a groove structure with a diameter of 60 nm to 120 nm and a depth of 120 nm to 250 nm, where the to-be-electroplated substrate is a patterned substrate with a physical vapor deposition (PVD) copper seed layer, the electroplating temperature is the room temperature, a three-operation current method is used in the electroplating process. In the first operation, the current density is 0.65 ASD, and the electroplating time is 6 seconds; in the second operation, the current density is 1 ASD, and the electroplating time is 40 seconds; and in the third operation, the current density is 6 ASD, and the electroplating time is 45 seconds.

Figure 6A:
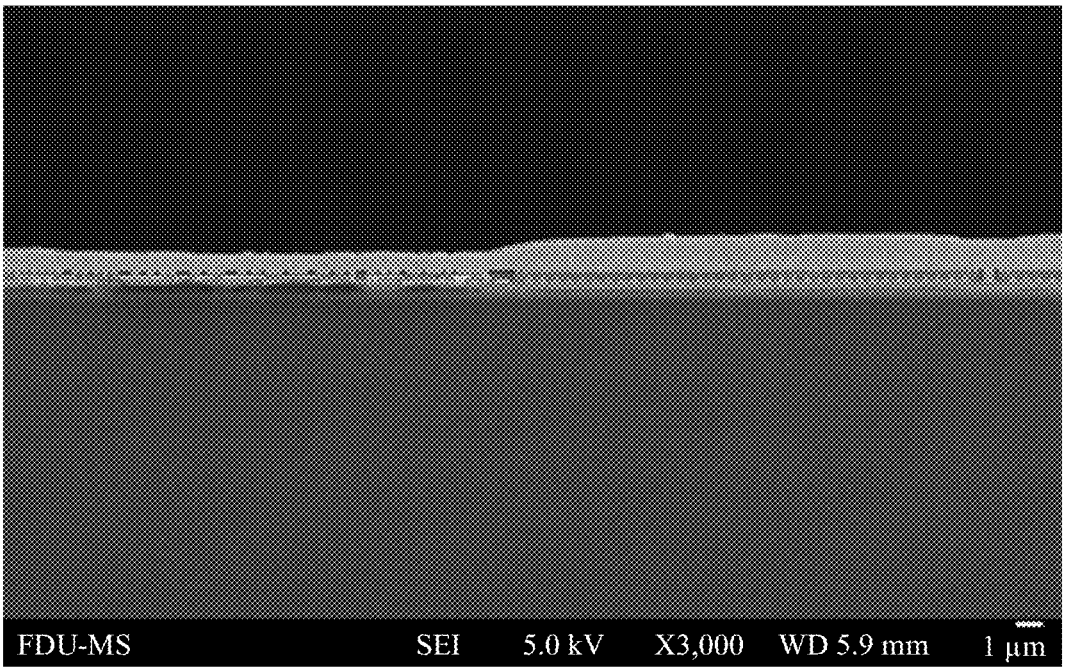
FIG. 6A and FIG. 6B are cross-section electron microscope photos of an electroplated sample according to a comparative example, where
Figure 6B:
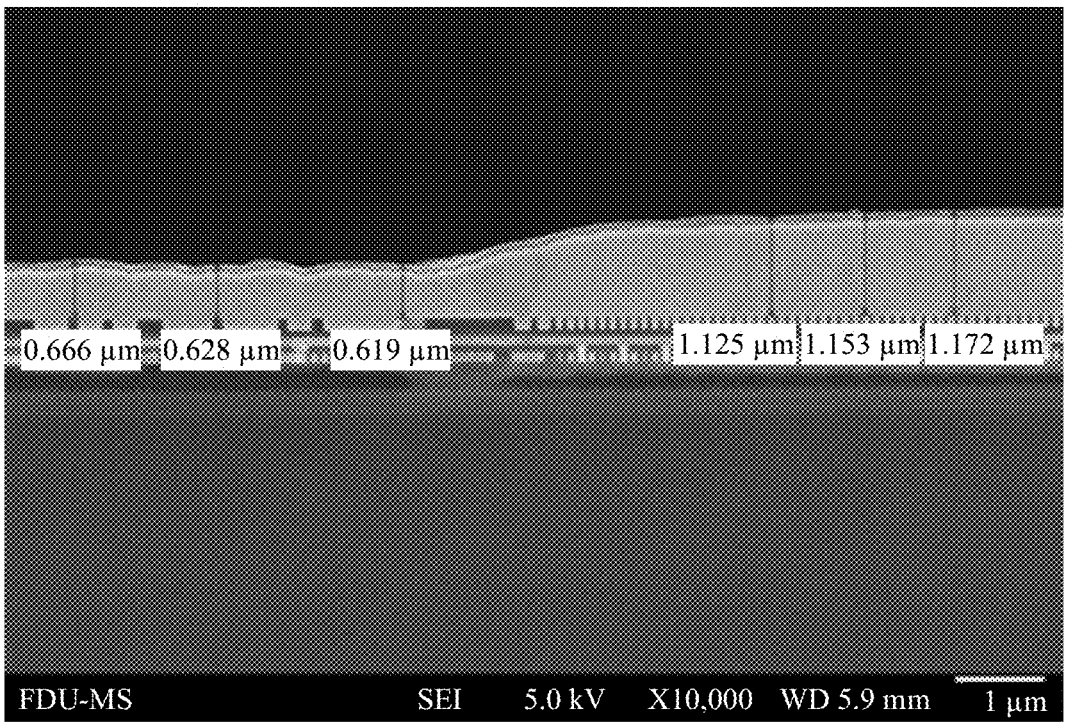

FIG. 6A and FIG. 6B are cross-section electron microscope photos of an electroplated sample according to a comparative example, where FIG. 6B is a partial enlarged view of FIG. 6A. It can be learned from FIG. 6A and FIG. 6B that, when the leveling agent is not added, the copper layer surfaces of the high-density groove region and the low-density groove region undulate greatly, and a ratio of an average thickness of the copper layer in the high-density groove region to that of the copper layer in the low-density groove region is up to 1.806, and it is difficult to perform a subsequent CMP operation.

Figure 7:
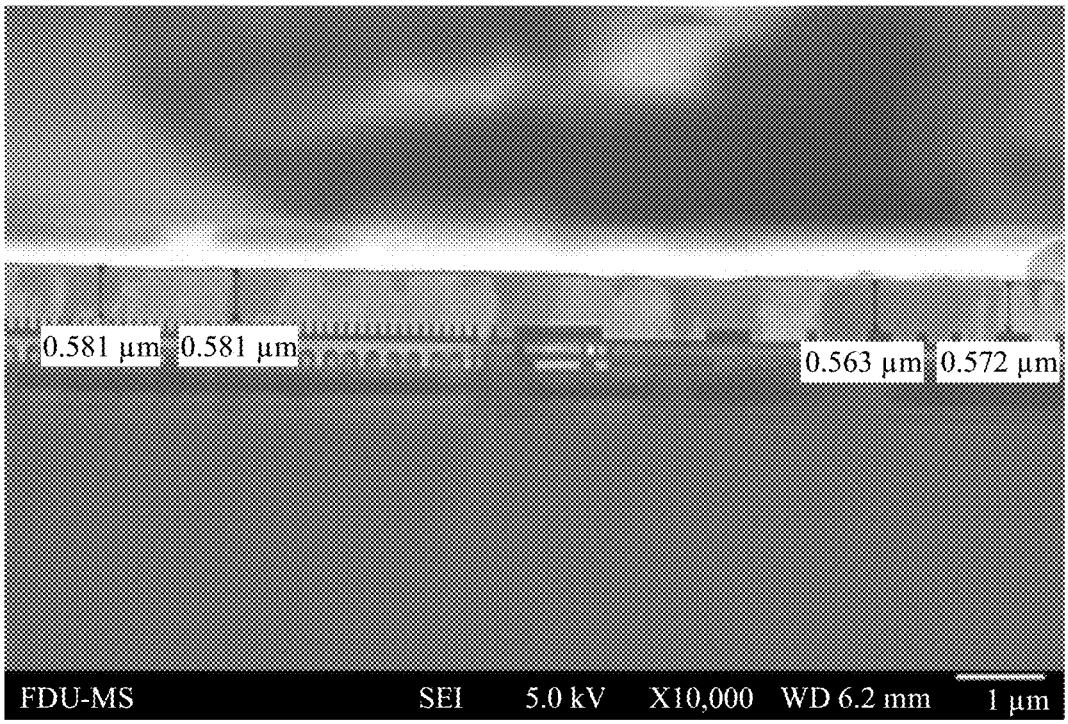
FIG. 7 is a cross-section electron microscope photo of a sample after electroplating according to Embodiment 1 of the present disclosure.

FIG. 7 is a cross-section electron microscope photo of a sample after electroplating according to Embodiment 1 of the present disclosure. It can be learned from FIG. 7 that, when the leveling agent of a polypyridine compound A is added, the copper layer surface in the high-density groove region and the low-density groove region undulate insignificantly, a ratio of an average thickness of the copper layer in the high-density groove region to that in the low-density groove region is only 1.023, and flatness is greatly improved, thereby greatly reducing burden on a subsequent CMP polishing process. In addition, it can also be learned from FIG. 7 that the electroplating solution with the leveling agent of the polypyridine compound A implements defect-free filling of small-sized grooves and simultaneous high-flatness filling in the case of different sizes and different distribution densities.

Embodiment 2

A polypyridine compound B shown in Formula (1):

Formula (1)

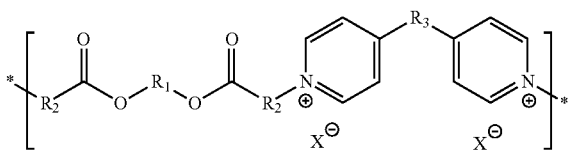

$R_1$ is

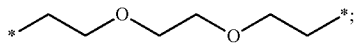

$R_2$ is

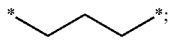

and $R_3$ is

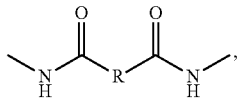

$X^-$ is $Cl^-$, n is 4, and * indicates a linking position.

The preparation method for the polypyridine compound B is as follows:

(1) Add 50 mL of dichloromethane, 20 mmol of triethylene glycol, and 40 mmol of triethylamine to a three-neck flask provided with a thermometer, a mixer, and a constant-pressure drip funnel, start the mixer, and control the temperature to range from 0° C. to 10° C.

(2) Dissolve 40 mmol of 4-chlorobutyryl chloride in dichloromethane, and transfer the obtained solution to the constant-pressure drip funnel, so that the 4-chlorobutyryl chloride solution drips slowly at a speed of 1 mL/min at a temperature of 0° C. to 10° C. After the dripping is complete, make the reaction last for more than 12 hours at a room temperature. Then, evaporate the reaction mixture to remove the dichloromethane, and then dissolve the obtained solution by using ethyl acetate and water, to extract the organic phase of ethyl acetate, and then evaporate the obtained solution after washing with water, to obtain an intermediate of the ester.

(3) Add 20 mmol of the obtained intermediate of the ester and 20 mmol of the compound containing the bipyridine structure shown in Formula (c-1) to a round-bottom flask provided with a mixer, start the mixer, and increase the temperature to 120° C.; and after 12 hours of reaction, decrease the temperature to the room temperature, to obtain the final polypyridine compound B in solid state.

Formula (c-1)

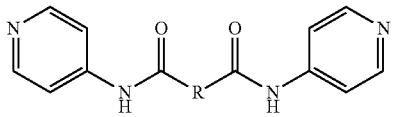

A copper electroplating solution includes components at the following mass ratios:

Copper sulfate pentahydrate (in terms of copper ions): 50 g/L

Sulfuric acid: 50 g/L

Chloride ion: 50 ppm

Polypyridine compound A: 10 ppm

Accelerator sodium polydithiodipropane sulfonate (SPS): 25 ppm

Inhibitor L65 (propylene glycol block polyether): 150 ppm.

The copper electroplating solution in Embodiment 2 is used to fill electroplating copper for a to-be-electroplated substrate having a groove structure with a diameter of 40 nm to 120 nm and a depth of 100 nm to 250 nm, where the to-be-electroplated substrate is a patterned substrate with a PVD copper seed layer, the electroplating temperature is the room temperature, a three-operation current method is used in the electroplating process. In the first operation, the current density is 0.65 ASD, and the electroplating time is 6 seconds; in the second operation, the current density is 1 ASD, and the electroplating time is 40 seconds; and in the third operation, the current density is 6 ASD, and the electroplating time is 45 seconds.

Figure 8:
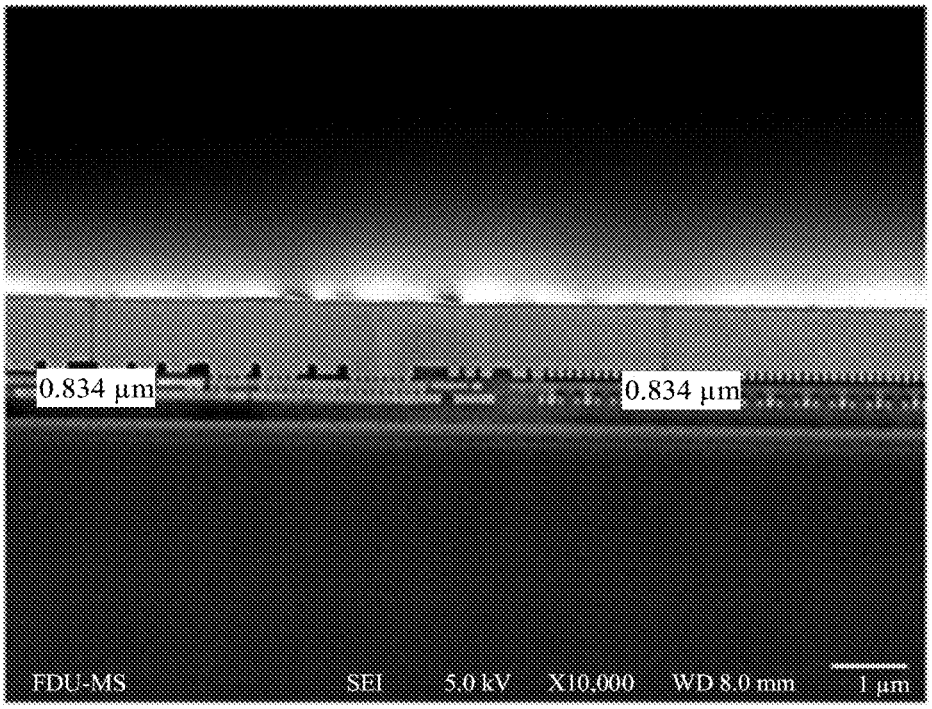
FIG. 8 and FIG. 9 are cross-section electron microscope photos of a sample after electroplating according to Embodiment 2 of the present disclosure.
Figure 9:
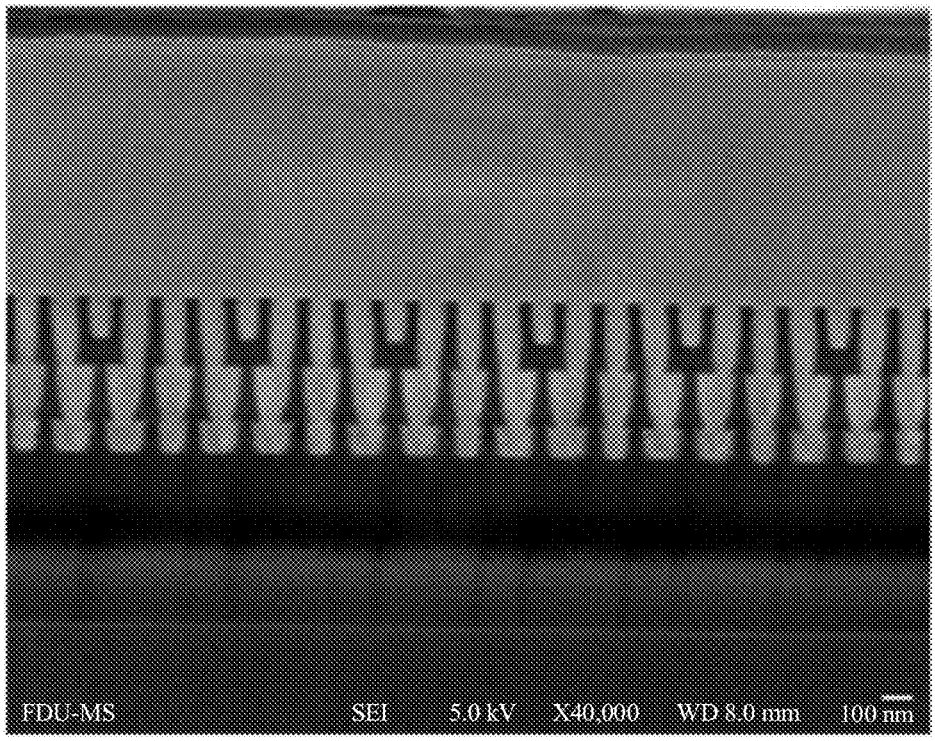

FIG. 8 and FIG. 9 are cross-section electron microscope photos of a sample after electroplating according to Embodiment 2 of the present disclosure. It can be learned from FIG. 8 and FIG. 9 that, when the leveling agent of a polypyridine compound B is added, the copper layer surface in the high-density groove region and the low-density groove region undulate insignificantly, a ratio of an average thickness of the copper layer in the high-density groove region to that in the low-density groove region is only 1.0, and flatness is greatly improved, thereby greatly reducing burden on a subsequent CMP polishing process. It can also be learned from FIG. 8 and FIG. 9 that addition of the electroplating solution with the leveling agent of the polypyridine compound A implements defect-free filling of small-sized grooves and simultaneous high-flatness filling in the case of different sizes and different distribution densities.

It can be learned from when the foregoing embodiment that the new leveling agent in this embodiment of the present disclosure is added to the electroplating composition to fill electroplating copper, it can be ensured that seam-free filling of the metallic copper can be implemented on nano-level submicron-level grooves of different sizes, and the leveling agent finally achieves a good flatness effect by inhibiting over-deposition of copper. This ensures that a relatively small-sized pattern is not fully filled in advance, and significantly reduces the platform undulation of the surface of the plated layer, so that a sample with an even surface copper thickness and a good appearance of the substrate surface is obtained, thereby simplifying the subsequent polishing process and improving the reliability of the final product.

It should be understood that "first", "second", and various numbers in this specification are merely used for differentiation for ease of description, but are not intended to limit the scope of the present disclosure.

In the present disclosure, "and/or" describes an association relationship between associated objects, and indicates that three relationships may exist. For example, A and/or B may indicate the following three cases: Only A exists, both A and B exist, and only B exists, where A and B may be singular or plural. The character "/" generally indicates an "or" relationship between the associated objects.

In the present disclosure, at least one means one or more, and a plurality of means two or more. "At least one of the following items (pieces)" or a similar expression thereof means any combination of these items, including any combination of singular items (pieces) or plural items (pieces). For example, both "at least one of a, b, or c" and "at least one of a, b, and c" may indicate: a, b, c, a-b (namely, a and b), a-c, b-c, or a-b-c, where a, b, and c may be singular or plural.

It should be understood that sequence numbers of the foregoing processes do not mean execution sequences in various embodiments of the present disclosure. Some or all of the operations may be performed in parallel or in sequence. The execution sequences of the processes should be determined based on functions and internal logic of the processes, and should not be construed as any limitation on the implementation processes of embodiments of the present disclosure.

What is claimed is:

1. A composition comprising a metal ion source and a leveling agent, wherein the leveling agent is a polypyridine compound, and the polypyridine compound comprises a structural unit shown in Formula (I) or a protonated product of the structural unit shown in Formula (I):

Formula (I)

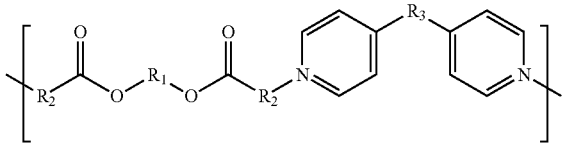

wherein in Formula (I), $R_1$ is alkylene containing an ether oxygen atom, denoted as $—(R_4O)_x\text{-}L\text{-}(R_5O)_y—R_5—$, wherein $R_4$ and $R_5$, are same or different alkylene, x is an integer greater than or equal to 0, y is an integer greater than or equal to 1, and L represents a single bond or at least one ether oxygen block; and $R_2$ is any one of the following: substituted or unsubstituted alkylene, substituted or unsubstituted arylene, substituted or unsubstituted arylene alkyl, substituted or unsubstituted alkylene aryl, alkylene containing an ether oxygen atom, ester, and/or imide, arylene containing an ether oxygen atom, ester, and/or imide, arylene alkyl containing an ether oxygen atom, ester, and/or imide, or alkylene aryl containing an ether oxygen atom, ester, and/or imide; and $R_3$ is any one of the following: a single bond, substituted or unsubstituted alkylene, substituted or unsubstituted arylene, substituted or unsubstituted arylene alkyl, substituted or unsubstituted alkylene aryl, and a linking group containing an ether oxygen atom, ester, and/or imide.

2. The composition according to claim 1, wherein the polypyridine compound comprises a protonated product and a halide ion of the structural unit shown in Formula (I), and the halide ion comprises any one of the following: a fluoride ion, a chloride ion, a bromide ion, and an iodide ion.

3. The composition according to claim 1, wherein in $R_2$, and $R_3$, a quantity of carbon atoms in the substituted or unsubstituted alkylene ranges from 1 to 30, and a quantity of carbon atoms in the substituted or unsubstituted arylene ranges from 6 to 30.

4. The composition according to claim 1, wherein in the composition, a concentration of the leveling agent ranges from 1 ppm to 100 ppm.

5. The composition according to claim 1, wherein the composition further comprises one or more of the following: an accelerator, an inhibitor, or an inorganic additive.

6. The composition according to claim 1, wherein the accelerator comprises one or more of the following: 3-mercapto-1-propane sulfonate, sodium polydithiodipropane sulfonate, or N,N-dimethyl-dithiocarboxamidopropane-sulfonate sodium; and a concentration of the accelerator in the composition ranges from 1 ppm to 50 ppm.

7. The composition according to claim 5, wherein the inhibitor comprises one or more of the following: polyethylene glycol, polypropylene glycol, a block copolymer PEO-PPO-PEO, a block copolymer PPO-PEO-PPO, a random copolymer of EO and PO, or a propylene glycol block polyether; and the concentration of the inhibitor in the composition ranges from 1 ppm to 2000 ppm.

8. The composition according to claim 1, wherein the composition further comprises at least one acid, and the at least one acid comprises sulfuric acid and/or methyl sulfonate.

9. The composition according to claim 1, wherein a concentration of the at least one acid in the composition ranges from 1 g/L to 100 g/L.

10. The composition according to claim 1, wherein the metal ion source comprises any one of the following: a copper ion source, a nickel ion source, a tin ion source, a cobalt ion source, a ruthenium ion source, or a silver ion source.

11. The composition according to claim 10, wherein the copper ion source comprises copper sulfate pentahydrate and/or copper methyl sulfonate; and a concentration of the copper ion source in the composition ranges from 1 g/L to 100 g/L in terms of copper ions.

12. The composition according to claim 1 wherein x is 0, L is a single bond, $R_5$ is ethylidene, and $R_1$ is —$(CH_2CH_2O)_y$—$CH_2CH_2$—.

13. The composition according to claim 1, wherein $R_3$ is a linking group containing imide and is denoted as —HN—C(=O)—R—C(=O)—NH—, wherein R is substituted or unsubstituted alkylene.

* * * * *